US011633839B2

(12) United States Patent
Pelletier

(10) Patent No.: US 11,633,839 B2
(45) **Date of Patent: *Apr. 25, 2023**

(54) SAFETY DEVICE FOR TACKERS

(71) Applicant: Stanley Black & Decker, Inc., New Britain, CT (US)

(72) Inventor: Thomas Pelletier, Wallingford, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 10 days.

This patent is subject to a terminal disclaimer.

(21) Appl. No.: 17/077,072

(22) Filed: Oct. 22, 2020

(65) Prior Publication Data

US 2021/0039238 A1 Feb. 11, 2021

Related U.S. Application Data

(63) Continuation of application No. 15/076,715, filed on Mar. 22, 2016, now Pat. No. 10,814,465.

(51) Int. Cl.
*B25C 1/00* (2006.01)
*B25C 5/06* (2006.01)

(52) U.S. Cl.
CPC ..... *B25C 1/008* (2013.01); *B25C 5/06* (2013.01)

(58) Field of Classification Search
CPC ..... B25C 1/00; B25C 1/008
USPC ..... 227/156
See application file for complete search history.

(56) References Cited

U.S. PATENT DOCUMENTS

| | | | | |
|---|---|---|---|---|
| 2,117,741 | A | 5/1938 | Polzer | |
| 2,537,601 | A | 1/1951 | Peterson | |
| 2,775,764 | A | 1/1957 | Maynard | |
| 3,572,572 | A | 3/1971 | Readyhough et al. | |
| 4,197,974 | A | 4/1980 | Morton et al. | |
| 4,265,320 | A | 5/1981 | Tanaka et al. | |
| 4,319,705 | A | 3/1982 | Geist et al. | |
| 4,349,143 | A * | 9/1982 | Ewig | B25C 5/15 227/134 |

(Continued)

FOREIGN PATENT DOCUMENTS

| | | |
|---|---|---|
| DE | 4442657 A1 | 6/1995 |
| DE | 29711755 U1 | 9/1997 |

(Continued)

OTHER PUBLICATIONS

Extended European Search Report dated Dec. 10, 2017 in corresponding application No. 17161063.7-1701.

*Primary Examiner* — Thanh K Truong
*Assistant Examiner* — Patrick B Fry
(74) *Attorney, Agent, or Firm* — Gabriel A. Haboubi

(57) ABSTRACT

A safety device for tackers includes a safety slide slidably connected to the outlet of the tacker and the safety slide has a stop protruding from the inside thereof. The rod has one end contacts the stop and the other end of the rod has a plastic tip connected thereto. An ignition spring is connected between the plastic tip and a safety switch. A recovery spring is connected to another position of the rod to position the rod. The safety slide is slidably connected to grooves of the tacker. When the safety slide contacts against an object to be stapled, the rod is pushed by the stop and activates the ignition spring to activate the safety switch so as to reduce the impact of the rod and the safety switch.

13 Claims, 7 Drawing Sheets

(56) References Cited

U.S. PATENT DOCUMENTS 4,405,073 A 9/1983 Salleras Escalante
4,552,296 A 11/1985 Sheng
4,784,308 A 11/1988 Novak et al.
5,428,197 A 6/1995 McCurry et al.
5,692,665 A 12/1997 Lee
5,695,108 A 12/1997 Lee
5,735,444 A 4/1998 Wingert
5,794,832 A 8/1998 Chen
5,873,509 A 2/1999 Liao
5,918,790 A 7/1999 Donnell
6,012,622 A * 1/2000 Weinger ..... B25C 1/08 227/8
6,076,720 A 6/2000 Deng
6,082,604 A 7/2000 Dennis
6,257,477 B1 7/2001 Strååt et al.
6,267,284 B1 7/2001 Clark
6,279,808 B1 8/2001 Larsen
6,357,647 B1 * 3/2002 Ou ..... B25C 1/008 227/8
6,557,745 B2 5/2003 Wang
6,598,776 B2 7/2003 Adachi et al.
6,651,862 B2 11/2003 Driscoll et al.
6,695,197 B2 2/2004 Johansson
6,715,657 B2 4/2004 Chen
6,789,718 B2 9/2004 Canlas et al.
6,808,101 B2 10/2004 Laubach et al.
6,837,412 B2 1/2005 Lamb
6,938,812 B2 9/2005 Miller et al.
6,974,067 B2 12/2005 Chen
7,004,367 B1 2/2006 Shen et al.
7,011,242 B2 3/2006 Barlow et al.
7,086,573 B1 8/2006 Wen
RE39,567 E 4/2007 Larsen
7,284,685 B1 10/2007 Wojcicki
7,314,155 B2 1/2008 Moeller et al.
7,484,647 B2 2/2009 Yang
7,559,447 B2 7/2009 Chen et al.
7,628,304 B2 12/2009 Yamamoto et al.
7,726,533 B2 6/2010 Wojcicki
7,757,920 B2 7/2010 Shea et al.
7,766,204 B2 8/2010 Spasov et al.
7,918,374 B2 4/2011 Gardner et al.
7,971,767 B2 7/2011 Komazaki et al.
8,091,752 B2 1/2012 Jian et al.
8,220,687 B2 7/2012 Yamamoto et al.
8,322,006 B1 12/2012 Kodi
8,408,438 B2 4/2013 Taylor
8,413,867 B2 4/2013 Gardner et al.
8,430,290 B2 4/2013 Tebo
8,631,986 B2 * 1/2014 Hlinka ..... B25C 1/06 227/4
8,695,860 B2 4/2014 Wang et al.
8,985,424 B2 3/2015 Miyashita
2003/0222115 A1 12/2003 Chen
2005/0019442 A1 1/2005 Leu et al.
2005/0224555 A1 10/2005 Kirby et al.
2007/0090149 A1 4/2007 Segura et al.
2008/0017689 A1 1/2008 Simonelli et al.
2008/0264999 A1 10/2008 Lee
2009/0145946 A1 6/2009 Ebihara
2010/0187278 A1 * 7/2010 Lin ..... B25C 1/008 227/107
2011/0132959 A1 * 6/2011 Hlinka ..... B25C 1/06 227/8
2012/0043366 A1 2/2012 Wang et al.
2012/0261456 A1 10/2012 Lacy et al.
2013/0153621 A1 6/2013 Franz
2013/0221056 A1 8/2013 Chen
2013/0292446 A1 11/2013 Choy
2014/0175144 A1 6/2014 Chen
2014/0175145 A1 6/2014 Wang et al.
2014/0319196 A1 10/2014 Huang
2015/0014388 A1 1/2015 Moriwaki et al.
2015/0048138 A1 2/2015 Chen et al.
2015/0202757 A1 7/2015 Smeaton et al.
2015/0224637 A1 8/2015 Wolf et al.
2015/0314433 A1 11/2015 Fleischer et al.
2015/0352703 A1 12/2015 Wu
2018/0093370 A1 4/2018 Yip et al.

FOREIGN PATENT DOCUMENTS

EP 0987086 A2 3/2000
EP 1053080 B1 2/2003
EP 1188523 B1 8/2006
EP 1539432 B1 8/2006
EP 1263551 B1 1/2007
EP 1122043 B1 4/2007
EP 1364750 B1 3/2008
EP 1832390 B1 12/2008
EP 1260321 B1 3/2010
EP 1812207 B1 9/2010
EP 1621291 B1 10/2011
EP 2604389 A2 6/2013
EP 1741519 B1 10/2014
EP 2734338 B1 1/2016
EP 2450153 B1 4/2016
EP 2837470 B1 7/2016
EP 1930126 B1 9/2016
EP 2885110 B1 7/2017
EP 2861380 B1 8/2017
EP 2792453 B1 10/2018
EP 2660010 B1 1/2019
EP 2762275 B1 2/2020
EP 2842695 B1 12/2020

* cited by examiner

SAFETY DEVICE FOR TACKERS

CROSS REFERENCE TO RELATED APPLICATIONS

This application is a continuation of and claims priority to U.S. patent application Ser. No. 15/076,715, filed Mar. 22, 2016 and issuing as U.S. Pat. No. 10,814,465 on Oct. 27, 2020, which is incorporated herein by reference in its entirety.

BACKGROUND OF THE INVENTION

1. Fields of the Invention

The present invention relates to a safety device for a tacker, and more particularly, to a safety device including an ignition spring connected to the plastic tip on the rod and the ignition spring precisely contacts the safety switch.

2. Descriptions of Related Art

The conventional power tacker is disclosed in FIGS. 5 to 8, and generally comprises body 70 with an operation path 71 defined therein. A safety device 80 includes a rod 81 which is movably received in the operation path 71 and has a first end extending beyond an outlet 72 of the body 70 of the tacker. The first end is used to contact against an object to be stapled. A recovery spring 82 is connected to mediate portion of the rod 81 and positioned in a space 73 in the body 70 so as to provide a resilient recovery force to allow the rod to move back to its initial position. A plastic member 83 is connected to a second end of the rod 81 and has an extension 84 which is an inclined part. The inclined extension 84 is used to touch or activate a contact plate 91 of a safety switch 90. When the user pushes the first end of the rod 81 against the object to be stapled, the rod 81 is pushed backward and the extension 84 pushes the contact plate 91 of the safety switch 90 to send a signal to let one staple to be stapled to the object.

However, the extension 84 is usually made by plastic which may become fragile or deformed after a period of time of use, and this may not precisely activate the safety switch 90.

Besides, when the object to be stapled is thin and which means that the displacement of movement of the rod 81 cannot move the extension a sufficient distance to effectively activate the contact plate 91 of the safety switch 90 as shown in FIG. 7. Therefore, the stapling action may fail.

Furthermore, the conventional rod 81 does not have a proper index portion at the first end thereof so that the user may not notice that the stapling position is not at the desired position. This happens frequently when stapling a cable, and the sheath of the cable is broken.

After each stapling action, the rod 81 returns quickly and the extension 84 may hit the contact plate 91 of the safety switch 90 and even damage the safety switch 90.

The present invention intends to provide a safety device for a tacker, and includes an ignition spring connected to the plastic tip on the rod so as to precisely contact the safety switch and to eliminate the shortcomings mentioned above.

SUMMARY OF THE INVENTION

The present invention relates to a safety device for a tacker, and comprises a body having an outlet at the front end thereof, and an operation path is defied in the body and communicates with the outlet so as to receive a rod therein. The rod has a contact portion formed at the first end thereof, and a connection portion is formed at the mediate portion of the rod. A recovery spring is mounted to the connection portion to provide a recovery force to the rod. A seat is formed at the second end of the rod and has a plastic tip extending therefrom.

A safety slide is a U-shaped plate and has two wings. The safety slide is slidably mounted to the front end of the body and located corresponding to the outlet of the body. The safety slide has a bottom edge formed at the distal end thereof. An index portion is formed at the safety slide. A stop extends from the bottom of the safety slide and is located corresponding to the contact portion of the rod. When the safety slide is slid, the stop contacts the contact portion and drives the rod to be retracted into the body. An ignition spring is mounted to the plastic tip of the seat. A safety switch is located in the body and has a contact plate extending therefrom. The contact plate is pushed by the ignition spring to send a stapling signal when the rod is retracted back into the body.

Preferably, the index portion includes a side index portion on each of the two wings of the safety slide.

Preferably, the index portion includes a front index portion on the top of the safety slide.

Preferably, a notch is defined in the bottom edge of the safety slide.

Preferably, the plastic tip is located at the distal end of the seat and movable with the rod in the axial direction of the rod.

Preferably, the contact plate of the safety switch is pushed by the ignition spring.

The present invention provides the recovery spring and the ignition spring, the two springs absorb impact so that the rod does not hit the safety switch hardly.

The contact plate of the safety switch is pushed by the ignition spring so that even if the object to be stapled is thin, the contact plate can be activated by the ignition spring.

The user can check the position that the staples will be stapled on the object by the side and front index portions. The notch of the safety slide ensures that the cable to be stapled is secured.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
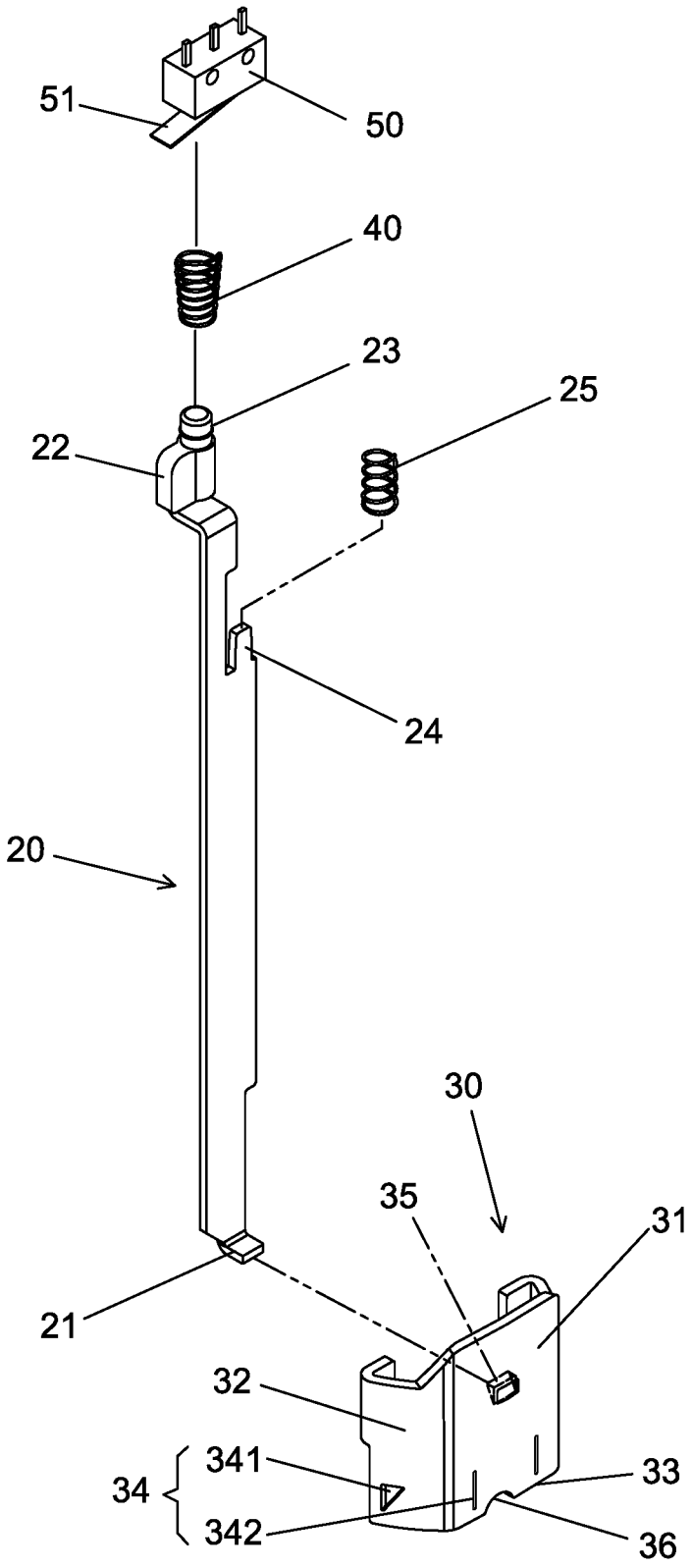
FIG. 1 shows the rod, the safety slide, and the safety switch of the safety device of the present invention.
Figure 2:
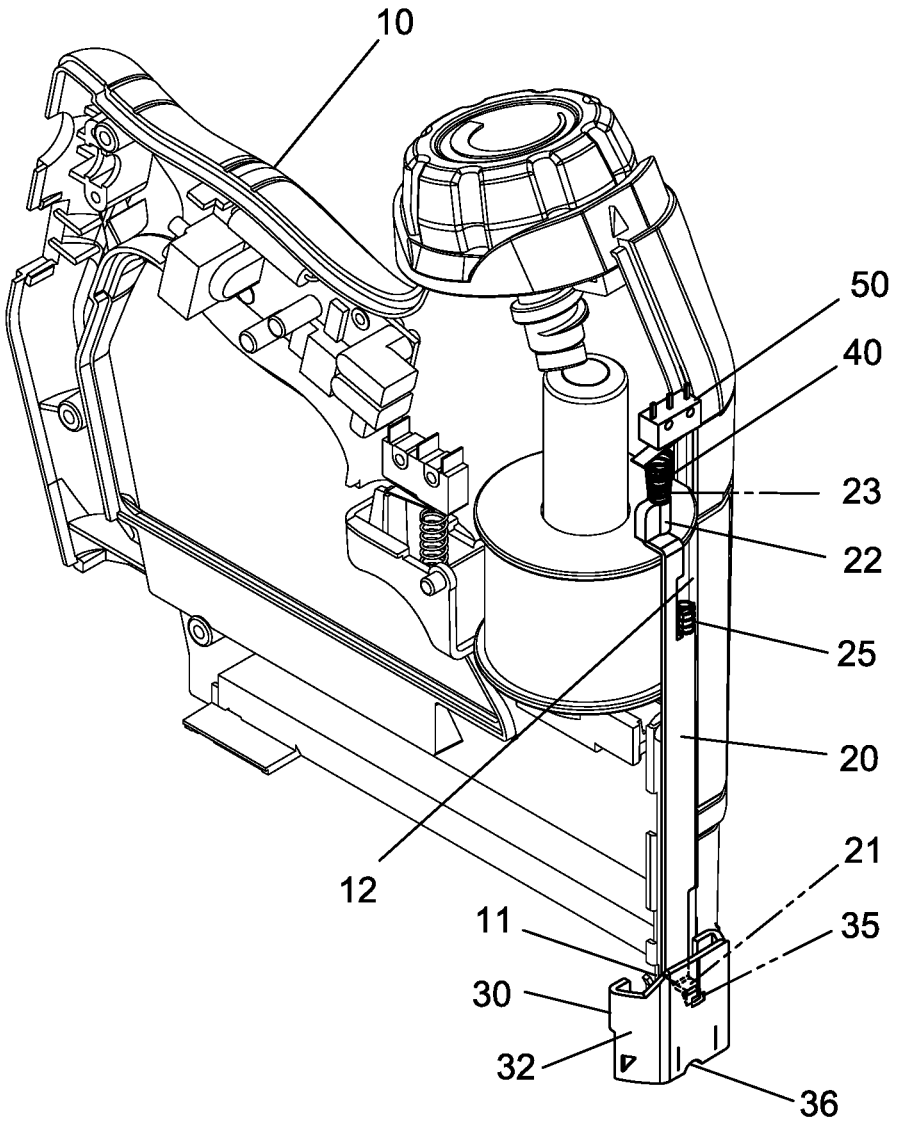
FIG. 2 is a perspective view to show the safety device of the present invention installed in a tacker.

Referring to FIGS. 1 and 2, the safety device of the present invention comprises a body 10 having an outlet 11 defined through the front end thereof, and an operation path 12 is defied in the body 10 and communicates with the outlet 11. A rod 20 is movably located in the operation path 12 and has a contact portion 21 formed at the first end thereof. A seat 22 is formed at the second end of the rod 20 and has a plastic tip 23 extending therefrom. A recessed area is defined in one side of the mediate portion of the rod 20 and a connection portion 24 is formed at the recessed area. The connection portion 24 extends along the axial direction of the rod 20. A recovery spring 25 is mounted to the connection portion 24 to provide a recovery force to the rod 20.

Figure 4:
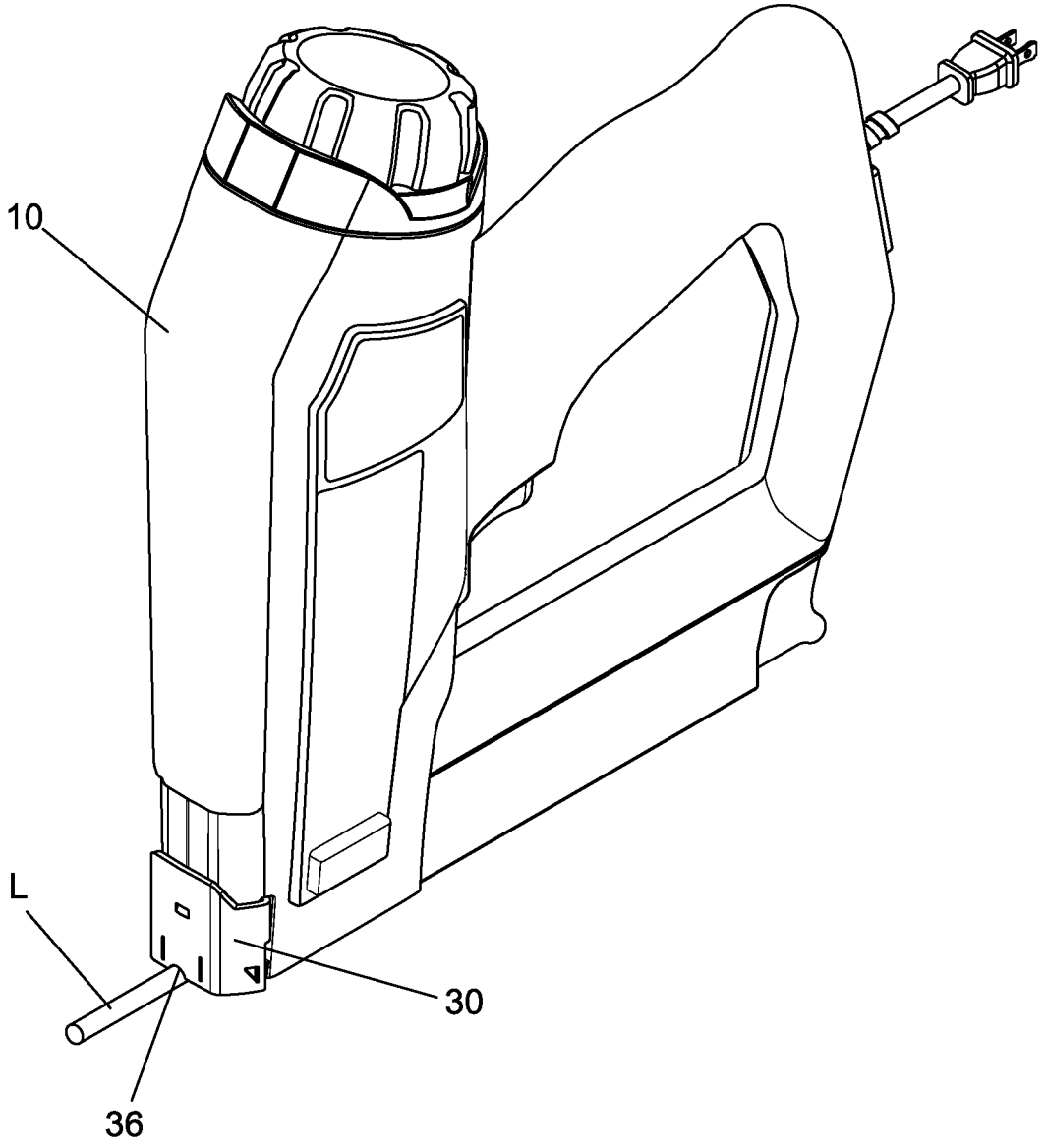
FIG. 4 shows that a cable to be stapled is positioned by the notch of the safety slide of the present invention.
Figure 5:
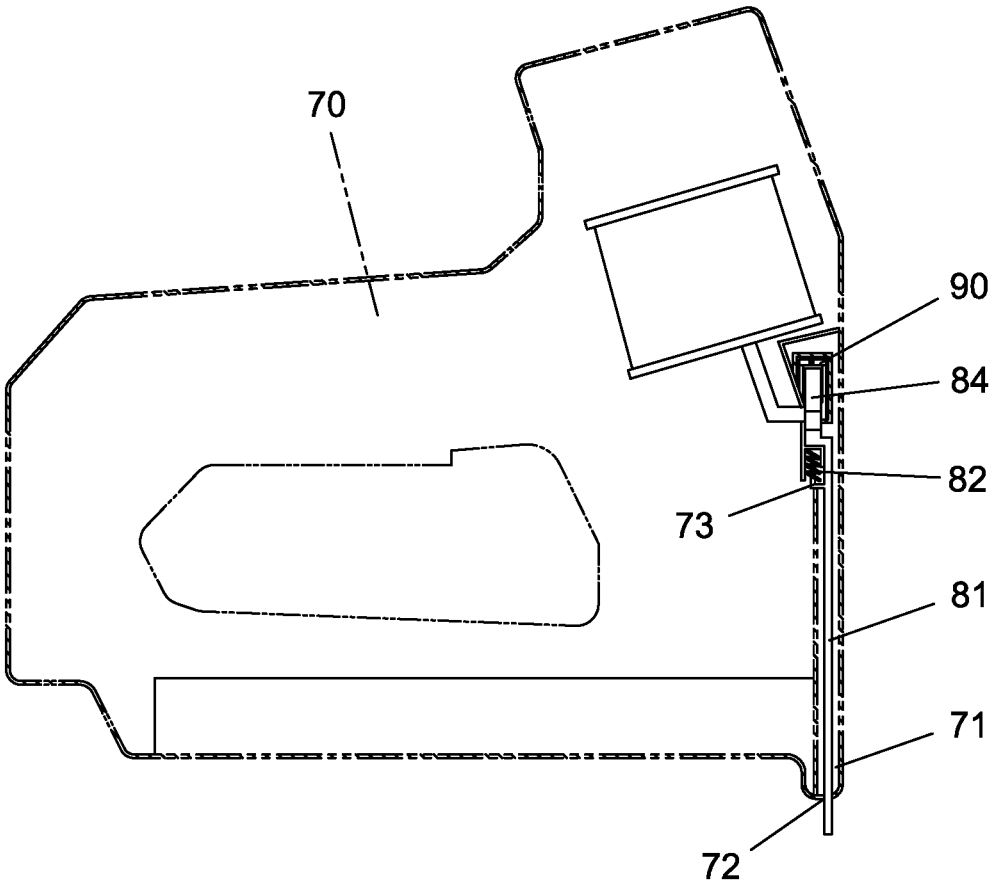
FIG. 5 PRIOR ART
FIG. 5 shows a conventional safety device installed in a tacker.
Figure 6:
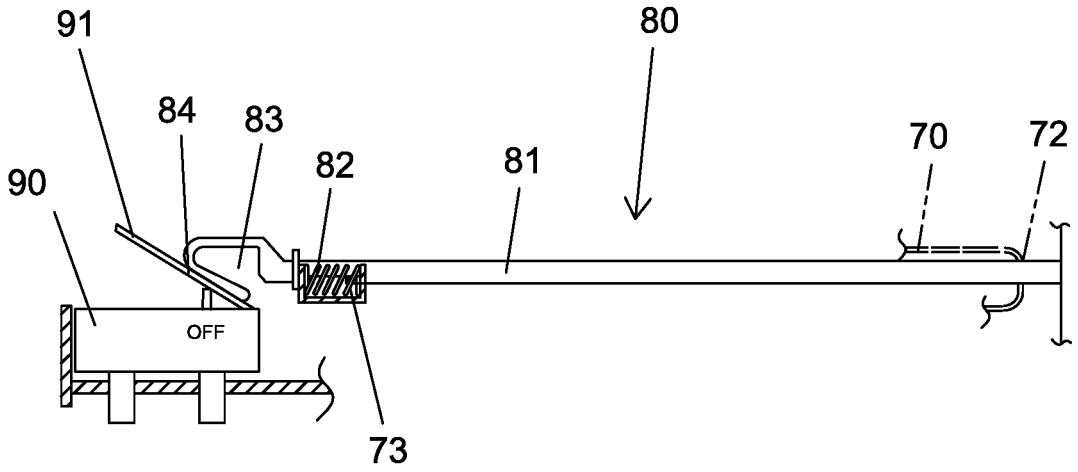
FIG. 6 PRIOR ART
FIG. 6 illustrates that the rod of the conventional safety device is about to contact against an object to be stapled.
Figure 7:
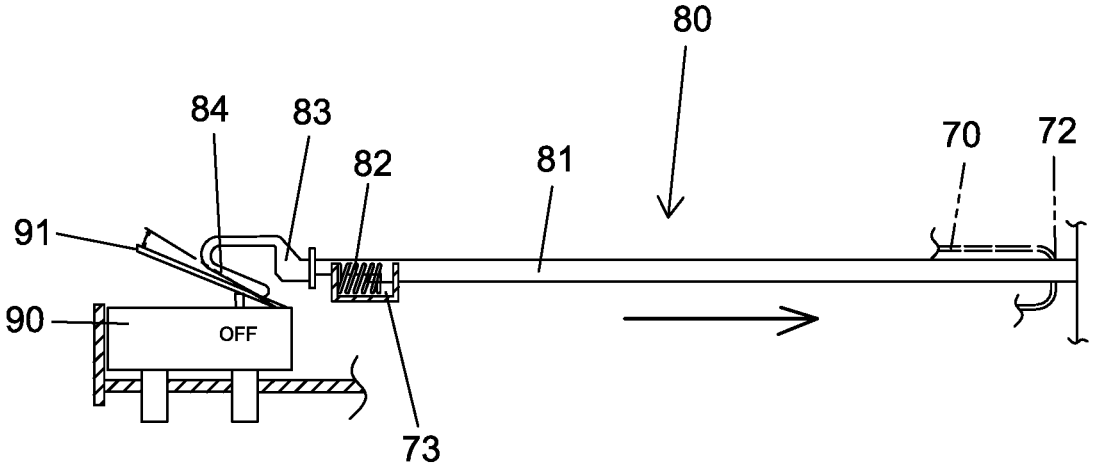
FIG. 7 PRIOR ART
FIG. 7 illustrates that the rod of the conventional safety device contacts a thin object to be stapled.
Figure 8:
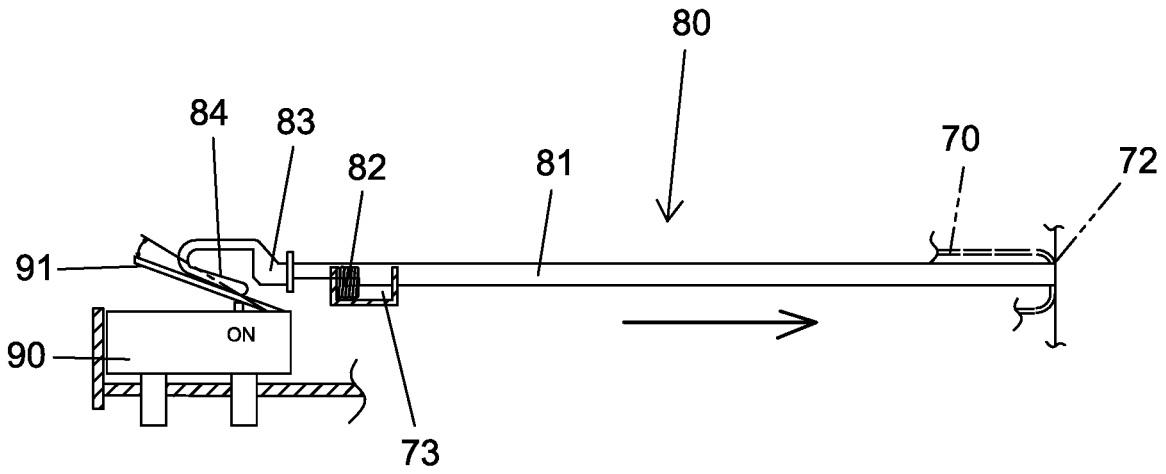
FIG. 8 PRIOR ART
FIG. 8 illustrates that the rod of the conventional safety device begins to move toward contacts against the object to be stapled.

A safety slide 30 is a U-shaped plate 31 and has two wings 32 extending from two sides thereof. The safety slide 30 is slidably mounted to the front end of the body 10 and located corresponding to the outlet 11 of the body 10. The safety slide 30 has a bottom edge 33 formed at the distal end thereof so as to contact against an object to be stapled. A notch 36 is defined in the bottom edge 33 of the safety slide 30 so as to secure a cable "L" as shown in FIG. 4 to be stapled. The shape and size of the notch 36 can be varied according to the cable "L" to be secured. An index portion 34 formed at the safety slide 30. The index portion 34 includes a side index portion 341 on each of the two wings 32 of the safety slide 30, and a front index portion 342 on the top of the safety slide 30. A stop 35 extends from the bottom of the safety slide 30 and is located corresponding to the contact portion 21 of the rod 20. An ignition spring 40 is mounted to the plastic tip 23 of the seat 22. The plastic tip 23 is located at the distal end of the seat 22 and movable with the rod 20 in the axial direction of the rod 20. A safety switch 50 is located in the body 10 and has a contact plate 51 extending therefrom. The contact plate 51 is pushed by the ignition spring 40 to send a stapling signal to the related electrical means of the tacker when the rod 20 is retracted back into the body 10. It is noted that the contact plate 51 of the safety switch 50 is pushed by the ignition spring 40 which is moved along the axial direction of the rod 20.

Figure 3:
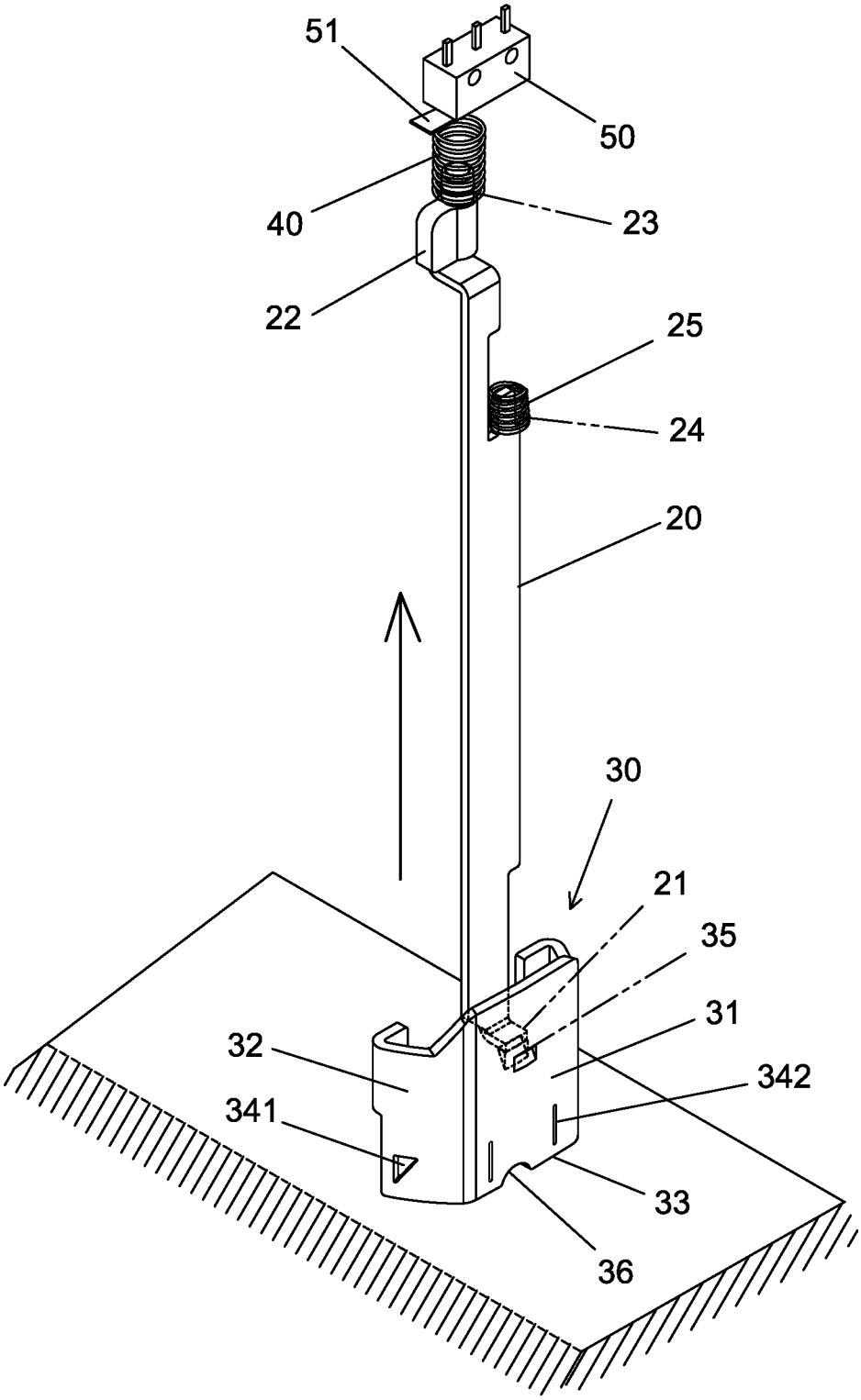
FIG. 3 shows that the rod is pushed against an object to be stapled and the rod is pushed backward.

As shown in FIG. 3, when the tacker is used to staple an object, the safety slide 30 is pushed against the object and slid upward, the stop 35 contacts the contact portion 21 and drives the rod 20 to be retracted into the body 10. The rod 20 moves backward and the ignition spring 40 is movable with the rod 20 and activates the contact plate 51 of the safety switch 50 so that a stapling signal is sent and the staple is ejected.

The ignition spring 40 is compressible so that when it touches the contact plate 51 of the safety switch 50, the compression of the ignition spring 40 absorbs a certain level of impact applied to the safety switch 50. This feature also prevent the plastic tip 23 from being damaged. The ignition spring 40 pushes the contact plate 51 along the axial direction of the rod 20 so that even if the object is thin, the safety switch 50 is activated properly.

The present invention provides the recovery spring 25 and the ignition spring 40, the two springs 25, 40 absorb impact so that the rod 20 does not hit the safety switch 50 hardly.

The user can check the position that the staples will be stapled on the object by the side and front index portions 341, 342 to prevent incorrectly stapling. The notch 36 of the safety slide 30 ensures that the cable "L" to be stapled is secured.

While we have shown and described the embodiment in accordance with the present invention, it should be clear to those skilled in the art that further embodiments may be made without departing from the scope of the present invention.

What is claimed is:

1. A tacker configured to eject a staple, the tacker comprising:

a body enclosing staple ejection electronics and an operation path defined in the body;

a rod movably located in the operation path and having a contact portion formed at a first end thereof proximal an outlet of the tacker, a connection portion formed at a mediate portion of the rod, and a seat formed at a second end of the rod;

a tip extending from the seat;

an ignition spring mounted to the seat, and a safety switch located in the body and having a contact plate extending therefrom, the contact plate touching the ignition spring and being pushed by the ignition spring to send a tacking signal when the rod is pushed;

wherein the contact plate of the safety switch is pushed by the ignition spring, which is moved along an axial direction of the rod.

2. The tacker of claim 1, further comprising a recovery spring mounted to the rod to provide a recovery force to the rod.

3. The tacker of claim 2, wherein the recovery spring is mounted to the connection portion of the rod.

4. The tacker of claim 3, wherein the recovery spring is mounted to a protrusion of the connection portion of the rod.

5. The tacker of claim 4, wherein the protrusion is received in the recovery spring.

6. The tacker of claim 2, wherein the recovery spring is configured to compress to provide the recovery force.

7. The tacker of claim 1, wherein the ignition spring compresses to absorb an impact between the rod and the safety switch.

8. The tacker of claim 1, wherein the rod is fixedly coupled to a safety slide extending from the housing.

9. The tacker of claim 8, wherein the contact portion contacts the safety slide, such that movement of the safety slide causes movement of the rod.

10. The tacker of claim 1, wherein the tip is located at a distal end of the seat and movable with the rod in an axial direction of the rod.

11. The tacker of claim 1, wherein the tip comprises plastic.

12. The tacker of claim 1, wherein the tip is received in the ignition spring.

13. The tacker of claim 1, wherein the tacker is a corded electric tacker.

* * * * *